US005272758A

United States Patent [19]

Isogami et al.

[11] Patent Number: 5,272,758

[45] Date of Patent: Dec. 21, 1993

[54] ELECTRET CONDENSER MICROPHONE UNIT

[75] Inventors: Shuzo Isogami, Yao; Mamoru Yasuda; Kouji Nishikawa, both of Kobe; Toshirou Izuchi; Kazuo Ono, both of Kitakyushu; Kiyoshi Ohta, Fukuoka, all of Japan

[73] Assignee: Hosiden Corporation, Osaka, Japan

[21] Appl. No.: 869,441

[22] Filed: Apr. 16, 1992

[30] Foreign Application Priority Data

Sep. 9, 1991 [JP] Japan ..... 3-072315[U]
Jan. 20, 1992 [JP] Japan ..... 4-001478[U]

[51] Int. Cl.[5] ..... H04R 25/00

[52] U.S. Cl. ..... 381/191; 381/168; 381/174

[58] Field of Search ..... 381/191, 174, 173, 113, 381/116, 168

[56] References Cited

U.S. PATENT DOCUMENTS 3,942,029 3/1976 Kawakami et al. ..... 381/191
4,626,729 12/1986 Lewiner et al. ..... 381/174
5,097,515 3/1992 Baba ..... 381/191

FOREIGN PATENT DOCUMENTS 0092199 6/1983 Japan ..... 381/191

*Primary Examiner*—Jin F. Ng
*Assistant Examiner*—Huyen D. Le
*Attorney, Agent, or Firm*—Pollock, VandeSande and Priddy

[57] ABSTRACT

An electret film is formed on the rear side of a front face plate of a cylindrical capsule made of aluminum . Closely in spaced opposition thereto, an electrically conductive diaphragm is held by an electrically conductive holding member. A wiring board provided behind the holding member closes the rear end of the capsule. The rear end of the capsule is bent on the rear periphery of the wiring board, and calked thereat. In the capsule, an impedance conversion IC device is connected to the electrically conductive holding member and the wiring board.

19 Claims, 8 Drawing Sheets

ELECTRET CONDENSER MICROPHONE UNIT

BACKGROUND OF THE INVENTION

The present invention relates to a condenser microphone unit using an electret.

FIG. 1 depicts a conventional front electret condenser microphone unit. On the front side of a cylindrical capsule 11 of aluminum a front face plate 11*a* is integrally formed, a in which a second hole 12 is formed in face plate 11*a* and a cloth 13 is attached on the front side of the face plate 11*a*. A diaphragm support metal ring 14 is provided on the peripheral portion on the inner side of the face plate 11*a* in opposition thereto, and electrically connected thereto. On the other surface of the metal ring 14, opposite to the surface thereof with the face plate 11*a*, an electret diaphragm 15 is stuck. The electret diaphragm 15 comprises a polymer film, for example, a rather thick FEP (Fluoro Ethylene Propylene) film of 12.5 μm, on one side of which a metal is vapor deposited. The polymer film which is polarized is supported at its periphery by the metal ring 14.

A back electrode 17 is disposed to oppose the diaphragm 15, in close vicinity thereto, via a ring-shaped spacer 16, and the back electrode 17 is held on the front end of a cylindrical back electrode holding member 18. In a back chamber 19 comprised of an interior of the back electrode holding member 18, an impedance conversion IC device 21 is disposed. An input terminal 22 of the IC device 21 is connected to the back electrode 17. An output terminal 23 and a common terminal (not illustrated) are protruded from the rear side of the capsule 11, and connected to wiring on a wiring board 24 that closes the rear side of the capsule 11. On the rear side of the wiring board 24, a rear end portion of the capsule 11 is bent so that each inner part is pressed against the face plate 11*a* for fixing the entire assembly.

FIG. 2 depicts a conventional back electret type condenser microphone unit. Although the diaphragm itself of the front electret type of FIG. 1 comprises an electret, the back electret type of FIG. 2 is composed of an electret polymer film 26 attached closely to the upper side of the back electrode 17. More explicitly, an electret polymer film, for example, a FEP film is melted to adhere on the upper side of the back electrode 17, and polarized to form an electret. Other details of the composition are the same as those in FIG. 1.

With conventional electret condenser microphone units shown in FIGS. 1 and 2, the back electrode 17 is required in addition to the other various parts. Therefore, it is difficult to assemble the unit automatically, resulting in a limited degree of cost reduction. Because an electret film is used as a diaphragm, there is a limit to making it thinner and therefore, the sensitivity cannot be made higher in excess of a limit.

SUMMARY OF THE INVENTION

An object of the present invention is to provide an electret condenser microphone unit which can be easily assembled automatically with a small number of parts and which has a high sensitivity.

According to the present invention, an electret polymer film is attached to the inner surface of a front face plate in a capsule. With a narrow spacing to said polymer film, an electrically conductive diaphragm is disposed in opposition thereto. The fringe portion of said electrically conductive diaphragm is held by an electrically conductive holding member, and connected electrically thereto. A wiring board is provided so that the rear side of the capsule is closed. An impedance conversion IC device disposed in the capsule is connected to the wiring board, and also connected to the holding member.

DETAILED DESCRIPTION OF THE INVENTION

Figure 1:
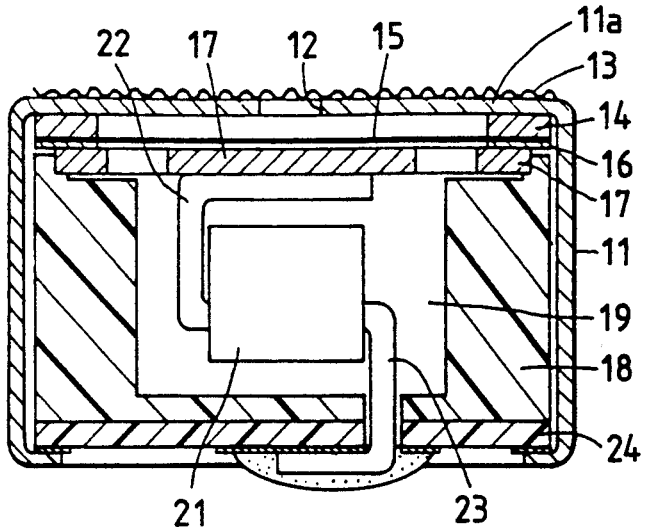
FIG. 1 PRIOR ART
FIG. 1 is a sectional view of a conventional front electret type microphone.
Figure 2:
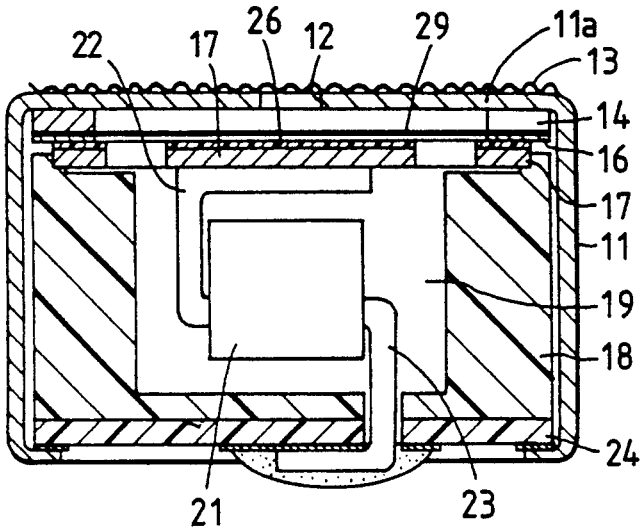
FIG. 2 PRIOR ART
FIG. 2 is a sectional view of a conventional back electret type microphone.
Figure 3:
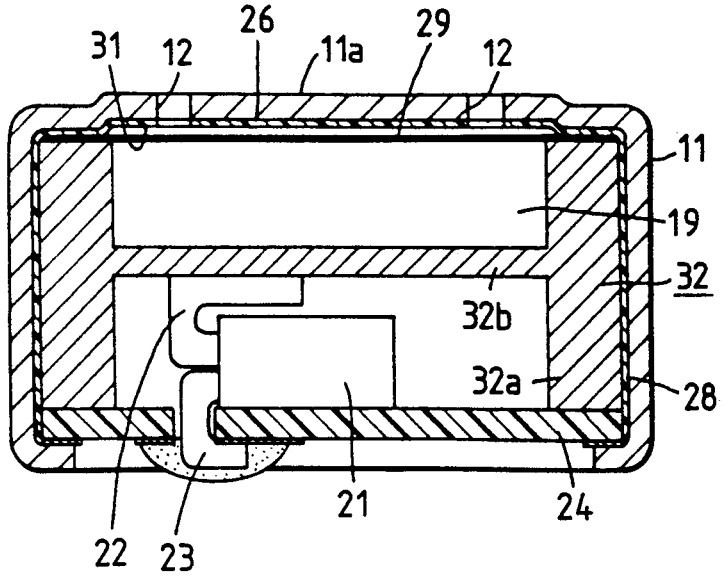
FIG. 3 is a sectional view of an embodiment of a microphone according to the present invention.
Figure 4A:
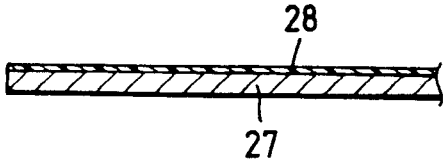
FIG. 4A is a view for explaining the manufacturing process of the capsule 11 in FIG. 3.

FIG. 3 depicts a first embodiment of the present invention in which parts corresponding to those in FIG. 1 are identified by the same numerals. In this embodiment, an electret polymer film 26 is stuck on the inner surface of the front plate 11*a* of the capsule 11. For instance, as shown in FIG. 4A, a polymer film, e.g. FEP film 28 is thermally melted evenly into a thickness of about 12.5–25 μm on one entire surface of an aluminum plate 27 of 0.3-0.35 mm in thickness. The aluminum plate 27 may advantageously be of JIS: A1100P, which is produced through annealing at 340° C. to 410° C. by air or in the furnace, and which is excellent in mildness and easy pressing in a later manufacturing process. In addition, it is also preferable that an oxide film is formed on the surface of the aluminum plate by a chemical processing so that the bonding force of the polymer film 26 is greater. It is also possible to make the bonding force of the polymer film 26 larger by treating the surface of the polymer film to be adhered, through a corona discharging process. The polymer film 26 can be continuously melted onto said aluminum plate 27, using a heat pressing roll.

Figure 4B:
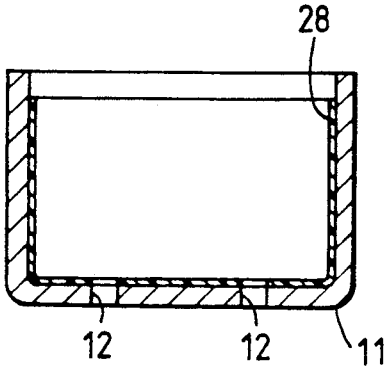
FIG. 4B is a view for explaining the manufacturing process of the capsule 11 in FIG. 3.
Figure 4C:
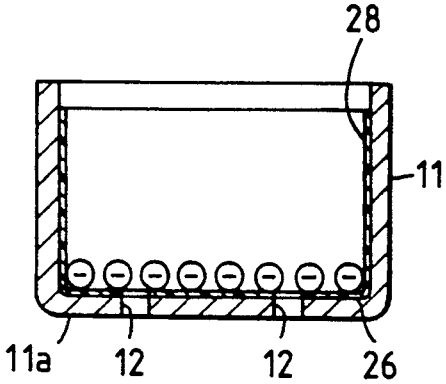
FIG. 4C is a view for explaining the manufacturing process of the capsule 11 in FIG. 3.

The aluminum plate 27 with said polymer film 26 stuck thereon is cupped, by pressing with reducing dies, into the capsule 11 with the FEP film 28 inside thereof as shown in FIG. 4B. At the same time, the polymer film 26 in the rear end fringe of the capsule is peeled by about 0.8 mm to expose a base metal of aluminum. A sound hole 12 is formed commonly through the front face plate of the capsule 11 and the FEP film 28. Next, a part of the FEP film 28 stuck on the inside of the front face plate 11*a* of the capsule 11 is polarized by an electron beam, thereby obtaining an electret polymer film 26 as shown in FIG. 4C.

FIG. 3 is now explained again. An electrically conductive diaphragm 29 is disposed in opposition to the electret polymer film 26 to define a narrow spacing such as 25 to 40 μm therebetween, except for a peripheral portion. The electrically conductive diaphragm 29 can for instance comprise an extremely thin 2 to 4 μm PET (polyester) film or polyphenylene sulfide (PPS) film on one side of which Ni or Al, etc. is vapor deposited to form an electrically conductive layer. The front face plate 11*a* is slightly pressed forward except for the peripheral portion thereof, thus creating a shallow recess 31. In the fringe portion of the electret polymer film 26, a peripheral portion of the electrically conductive diaphragm 29 is disposed in opposition thereto and in contact therewith. Hence, an air gap is formed between the electret polymer film 26 and the electrically conductive diaphragm 29, corresponding to the depth of the recess 31. Although the recess 31 is not illustrated in FIG. 4B or 4C, it is formed beforehand when the capsule is manufactured by pressing.

The electrically conductive holding member 32 is housed in the capsule 11 and holds the electrically conductive diaphragm 29 on the front end of the electrically conductive holding member 32. In addition, they are electrically connected with each other, that is, the electrically conductive layer of the electrically conductive diaphragm 29 is opposed to and made in contact with the electrically conductive holding member 32. In addition, a back chamber 19 is composed of the electrically conductive holding member 32 on the rear side of the electrically conductive diaphragm 29. The electrically conductive holding member 32 is formed by for example a metal casting which consists of a cylindrical portion 32*a* engaged with the capsule 11 and a partition portion 32*b* that divides the interior thereof into front and rear spaces. The front side of said electrically conductive holding member 32 is coated with an epoxy base electrically conductive adhesive which bonds the tensioned diaphragm 29 on its electrically conductive layer side thereof. The back chamber 19 is defined by a space between the partition portion 32*b* and the electrically conductive diaphragm 29. Since the polymer film 28 is covered on the inner peripheral surface of the capsule 11, the electrically conductive holding member 32 is electrically insulated from the capsule 11.

The rear side of the capsule 11 is closed by the wiring board 24. In this embodiment, the wiring board 24 is disposed in opposition to and in contact with the rear end of the electrically conductive holding member 32, while a rear end portion of the capsule 11 is bent to push and fix the holding member 32 and the wiring board 24 against the front face plate 11*a*. In between the wiring board 24 and the partition portion 32*b*, an impedance conversion IC device 21 is disposed and the input terminal 22 of the IC device 21 is connected to the partition portion 32*b*. An output terminal 23 and a common terminal (not illustrated) are led to the outside of the wiring board 24, and connected to an output wiring and a common wiring, respectively. Furthermore, a bent inner end fringe of the capsule 11 is connected to the common wiring in the rear periphery of the wiring board 24.

According to the construction described above, the diaphragm 29 vibrates according to a sound signal coming from the front side while varying a static capacitance between the electrically conductive diaphragm 29 and the front face plate 11*a*; thus the equipment acts as a condenser microphone.

The electrically conductive diaphragm 29 may also comprise electrically conductive layers formed on both sides of the polymer film. In this case, both of these electrically conductive layers are electrically connected. The electrically conductive holding member 32 is not limited to one that is formed entirely by a metal material, but can be formed of an insulation material shaped into a necessary form on which a metal layer is plated as an electrically conductive means. It is also possible to provide elevated portions in suitable intervals from the front face plate 11*a* to the holding member 32, while omitting the recess 31. A cloth may also be attached to the front side of the front face plate 11*a*.

Figure 5:
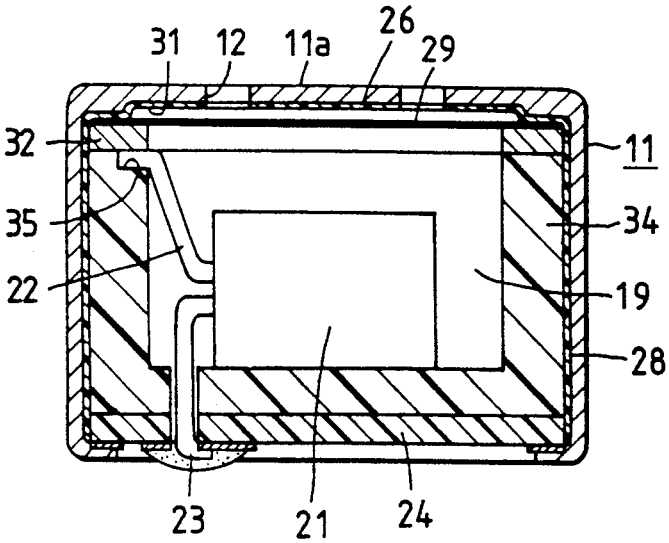
FIG. 5 is a sectional view of the second embodiment of the microphone according to the present invention.

FIG. 5 denotes a second embodiment of the electret condenser microphone according to the present invention, in which parts corresponding to those of FIG. 3 are identified by the same numerals. The electrically conductive holding member 32 in use is short in the axial direction like the conventional metal ring 14 shown in FIG. 1. A cylindrical member 34 made of an insulation material, for example, ABS resin may also be intercalated in between the electrically conductive holding member 32 and the wiring board 24. In this case, a recess 35 is formed in the front end of the cylindrical member 34 in which the end portion of the input terminal 22 of the IC device 21 is disposed. An end portion of said input terminal 22 protrudes slightly forwardly of the front side of the cylindrical member 34, the cylindrical member 34 is pressed against the electrically conductive holding member 32, and thus the input terminal 22 comes into contact with the electrically conductive holding member 32 while establishing electrical connection.

In the embodiment depicted in FIG. 5, the outer surface of the front face plate 11*a* of the capsule 11 is made flat instead of forming steps to create a recess 31, aiming at more beautiful appearance. The outer surface may be printed to prevent dazzling of the base metal of aluminum, or conditioned for easy clothing work. In addition, like in FIG. 3, the polymer film 28 in the rear end portion of the capsule 11 is removed at the same time as pressing the capsule 11, thereby exposing the base aluminum metal and calking the rear end portion of the capsule 11 onto the rear side of the wiring board 24. Thus, the capsule 11 is automatically connected to the common wiring in the rear periphery of the wiring board 24. The cylindrical member 34 in the illustration has the rear side thereof closed integrally. However, the rear side may also have an opening. In addition, the equipment can also be assembled more easily by encasing the holding member 32 with the diaphragm 29 retained, into the capsule 11 and then housing an assembly of the IC device 21, wiring board 24 and the cylindrical member 34 assembled beforehand, into the capsule 11.

Figure 6:
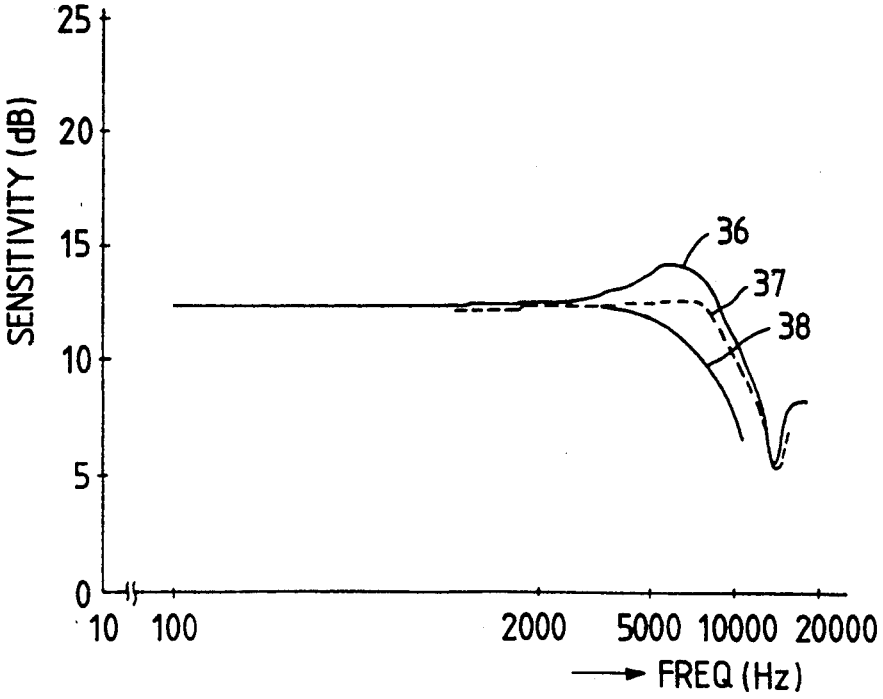
FIG. 6 is a graph depicting sensitivity vs. frequency characteristics of the microphone in FIG. 6.

By adequately selecting the diameter and number of sound holes 12 on the front face plate 11*a* of the capsule 11, it is possible to suppress creating a peak by a resonance frequency fo of the diaphragm 29 in a high-frequency range of the frequency characteristics as a microphone. For instance, in the case of using the capsule 11 of 9.3 mm in outer diameter and the diaphragm 29 of 7.0 mm in effective diameter, if five sound holes 12, each of 1.0 mm in diameter, or six sound holes, each of 0.8 mm in diameter, are formed in equal spacings on a circle of 3.5 mm in diameter around the axial center of the capsule 11, a peak is formed in a high-frequency range of the sensitivity vs. frequency characteristics as shown in the curve 36 of FIG. 6. However, where the number of 0.8 mm sound holes 12 is reduced to 5, the peak in the high-frequency range no longer exists as shown in the flat curve 37. If the diameter of each sound hole 12 is made further smaller, for instance, five 0.6 mm sound holes or four 0.8 mm sound holes are provided, sensitivity in the high-frequency range becomes low in excess as shown by the curve 38. Therefore, an optimum case is that five sound holes of 0.8 mm each in diameter are formed.

Figure 7:
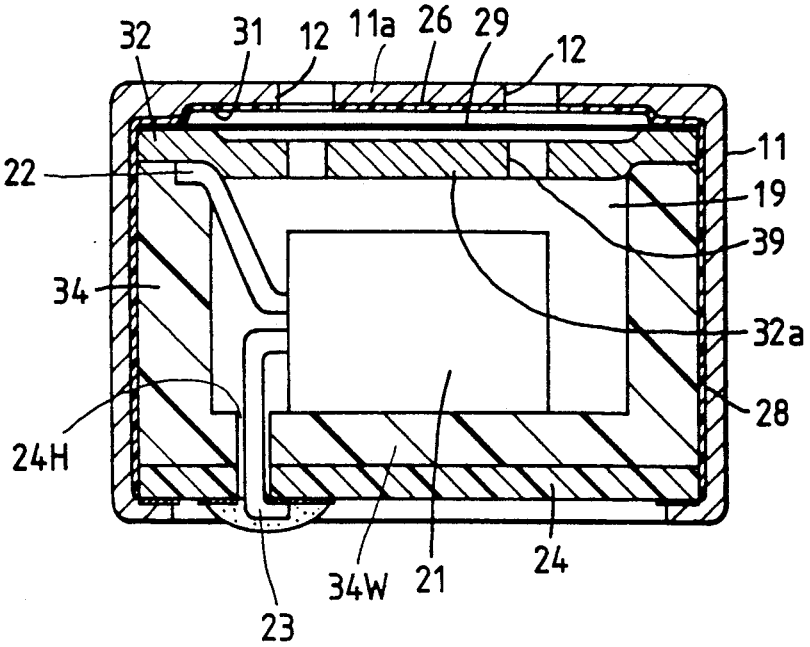
FIG. 7 is a sectional view of the third embodiment of the microphone according to the present invention.

FIG. 7 depicts a third embodiment of the present invention. As shown with the same numerals for parts corresponding to those of FIG. 5, the electrically conductive holding member 32 is shaped into a disk of which an inner part except for a periphery for holding the diaphragm 29 is constructed into a closure portion 32*a* recessed backwardly parallel to the diaphragm 29 while keeping a very small spacing (for instance, 20 to 30 μm) to the diaphragm 29. The closure portion 32*a* closes the rear chamber 19 behind the holding member 32 and sound holes 39 are formed in said closure portion 32*a*. By appropriately selecting the diameter and number of the sound holes 39, it is possible to suppress the peak in the high-frequency band in the sensitivity vs. frequency characteristics of FIG. 6, while making the characteristic curve flat. In that case, the diameter of each sound hole 12 is made slightly larger, for instance 1.0 mm and five of them are formed to prevent an adverse affect to the frequency characteristics.

Referring to FIGS. 5 and 7, it is also possible to omit the polymer film 28 on the inner side surface of the capsule 11 such that the electret polymer film 26 is bonded only to the front face plate 11*a* using an adhesive.

Figure 8A:
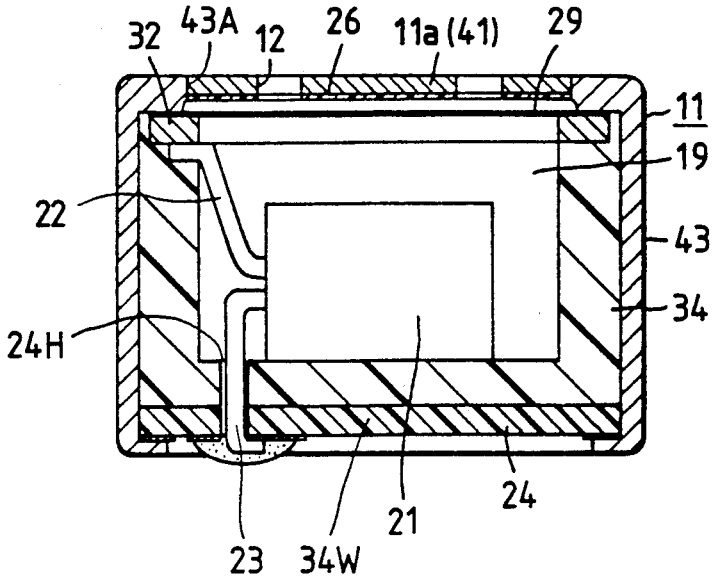
FIG. 8A is a sectional view of another embodiment of the microphone according to the present invention.
Figure 8B:
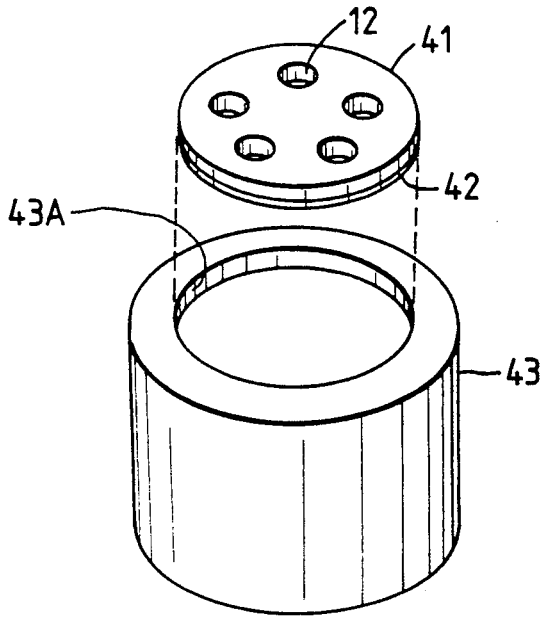
FIG. 8B is a disassembly oblique view of the capsule 11 in FIG. 7.

FIGS. 8A and 8B depict a fourth embodiment of the present invention. With the present embodiment, as shown in FIG. 8A, no polymer film is formed on the inner side surface of cylindrical aluminum member 43. Also, the front face plate 11*a* on which the electret polymer film 26 is formed is manufactured as a separate disk 41 which is press fit into an aperture 43A formed in the front face of the cylindrical member 43. More explicitly, as shown in FIG. 8B, a FEP film 42 is attached by melting or sticking on one side of the circular aluminum plate 41. Sound holes 12 are then drilled and the FEP film 42 is polarized into an electret polymer film 26. As shown in FIG. 8A, the aluminum plate 41 is press fit into the front aperture of the cylindrical aluminum member 43, as an integrated body which comprises the capsule 11. Other details of the construction are similar to those of the embodiment of FIG. 5.

Figure 9:
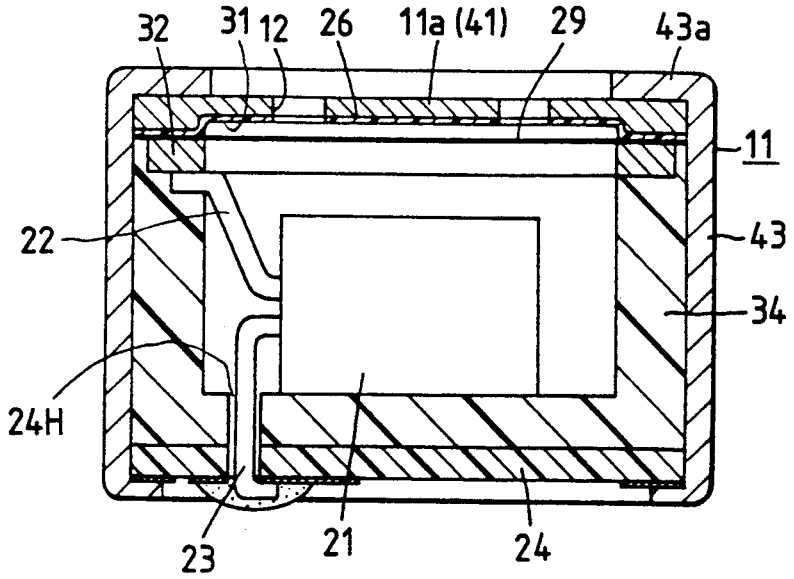
FIG. 9 is a sectional view of another embodiment of the microphone according to the present invention.

An embodiment modified from that of FIGS. 8A and 8B is shown in FIG. 9 where a separate circular front face plate 11*a* (41) coated with an electret polymer film can also be disposed in the inside. More explicitly, an electret polymer film 26 is formed on one side of a circular aluminum plate 41 which has a thick periphery and an inner part formed into a recess 31, and the aluminum plate 41 is pressed from the inside of the capsule 11 against a front flange 43*a* of the cylindrical member 43 as shown in FIG. 9, and fixed thereto thus forming the capsule 11.

In the description above, it is also possible to compensate the variance of polarizing degrees in the products of the electret polymer film 26, by intercalating a spacer between the periphery of the diaphragm 29 and the electret polymer film 26. In this case, it is also possible that no recess 31 is formed but the front face plate 11*a* has the same thickness in the entirety.

With a conventional front electret type microphone shown in FIG. 1, the electret diaphragm 15 is used. Therefore, it is difficult to make the thickness thereof less than 12.5 μm. Hence, the sensitivity cannot be made higher than a corresponding limit, for instance, −45 dB at 1 KHz. According to the front electret type microphone of the present invention as described referring to the various embodiments above, the thickness can be made for instance as thin as 2 μm because the diaphragm 29 need not be an electret. As a result, in the arrangement of FIG. 5, the sensitivity can be made −38 dB at 1 KHz, as much as 7 dB higher than before. Consequently, S/N is also made higher than 45 dB, thus improving conventional products by 5 dB. Also with other front electret types according to the present invention, similar performance can be expected.

In addition, since the electret polymer film 26 is formed on the inner surface of the capsule, the thickness thereof can be made thicker, for instance 25 μm. Correspondingly, the variance of polarizing degrees of related products can be made smaller along with higher stability.

Figure 10A:
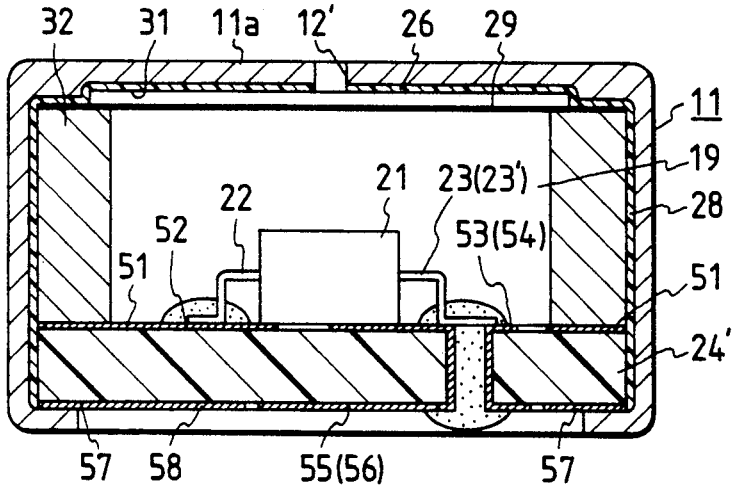
FIG. 10A is a sectional view of another embodiment of the microphone according to the present invention.
Figure 10B:
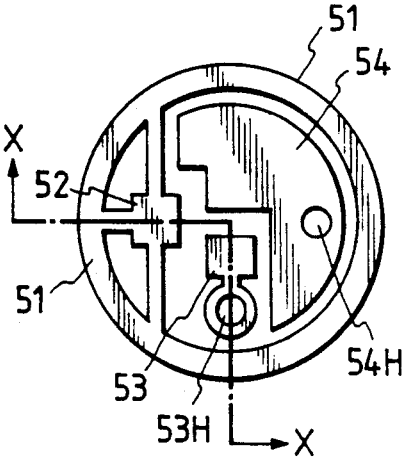
FIG. 10B is a surface conductor pattern view of the wiring board in FIG. 10A.
Figure 10C:
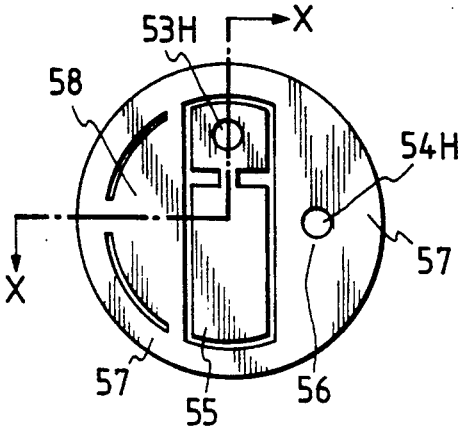
FIG. 10C is a rear side conductor pattern view of the wiring board in FIG. 10A.

Relating to manufacturing, for instance, the embodiments shown in FIGS. 5, 7, 8A, 9, etc., the impedance conversion IC device 21 is provided with an input terminal 22, output terminal 23 and a common terminal (not illustrated) for a lead wire. The output terminal 23 and the common terminal are inserted into lead wire entrance holes 24H penetrating the rear wall portion 34W of the cylindrical member 34 and the wiring board 24, and then the tips thereof are bent and soldered onto conductor patterns printed on the rear side of the wiring board. Such manufacturing processes as described above are required. However, it is difficult to automate these processes. Consequently, the construction is not suitable for automatically manufacturing and assembling microphone units. An embodiment improved in this regard is shown in FIG. 10A. With the embodiment of FIG. 10A, the wiring board in use comprises a double-sided wiring board 24'. In addition, the IC device 21 preferably is of a thin, chip type. In order to electrically connect the electrically conductive diaphragm 29 to the input terminal 22 of the IC device 21, a ring-shaped conductor pattern 51 is formed on the upper periphery of the double-sided wiring board 24' as shown in FIG. 10B. The rear end surface of the electrically conductive holding member 32 is coaxially stuck thereon. A conductor pattern 52 to which the input terminal 22 is to be soldered is formed to extend from the ring-shaped conductor pattern 51. The conductor patterns 53 and 54 to which the output terminal 23 and the common terminal 23' of the IC device 21 are to be soldered, respectively, are connected to the conductor patterns 55 and 56 on the rear side as shown in FIG. 10C, via the through-holes 53H and 54H, respectively. On the rear periphery of the wiring board 24', a ring-shaped conductor pattern 57 is formed in the same manner as with the embodiments described so far, while forming a common wiring pattern 58 extending from the ring-shaped conductor pattern 57. The conductor pattern 56 to be connected to the common terminal 23' of the IC device is actually connected to the common wiring pattern 58 via the ring-shaped conductor pattern 57. The section of the wiring board 24' in FIG. 10A is a section along the X—X line in FIGS. 10B and 10C.

In a mass production line, the IC device 21 is automatically positioned at a predetermined location of each double-side wiring board 24' by a mounter machine, and soldered automatically with a solder reflow system. At that time, the through-holes are filled with a solder metal to prevent venting air out of the back chamber 19, via the through-holes.

A recess 31 is formed on the rear surface of the front face plate 11*a*, defining a spacing to the electrically conductive diaphragm 29 by means of a step difference to the outer fringe thereof. With the embodiment of FIG. 10A, a slit hole 12' (for instance, 0.4 mm in width and 2.0 mm in length) is formed at a center portion of the front face plate 11*a*, in place of a number of circular sound holes 12 constructed in the embodiments described thus far. To assemble the microphone unit of FIG. 10A, first the polymer film 28 is formed on the inner wall surface of the capsule 11, and the polymer film on the rear surface of the front face plate 11*a* is polarized into an electret polymer film 26. Next, the electrically conductive cylindrical holding member 32 that retains an electrically conductive diaphragm 29 is inserted, and then a double-side wiring board 24' with a mounted IC device 21 is inserted. Eventually, the rear end portion of the capsule 11 is calked and fixed. These assembly steps can be easily automated.

Figure 11:
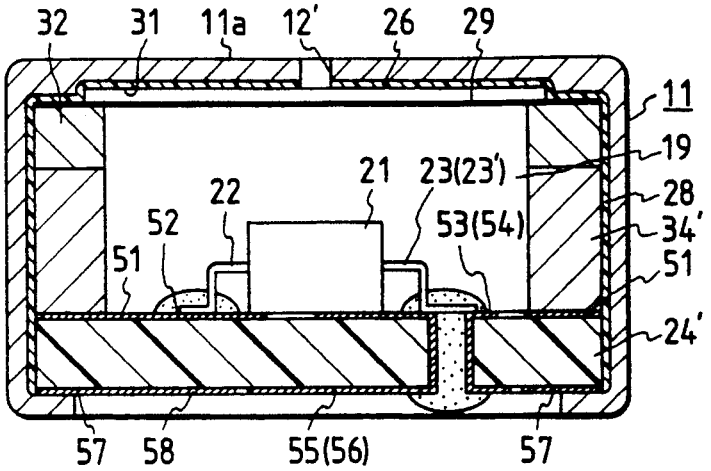
FIG. 11 is a sectional view for showing another modified embodiment of FIG. 10A.

FIG. 11 depicts an embodiment modified from the microphone unit of FIG. 10A, in which the electrically conductive diaphragm 29 is stuck to and fixed at the ring-shaped, electrically conductive holding member 32 while intercalating an electrically conductive cylindrical member 34' between said electrically conductive holding member 32 and the double-side wiring board 24'. Other details of the structure are similar to those of FIG. 10A.

Figure 12:
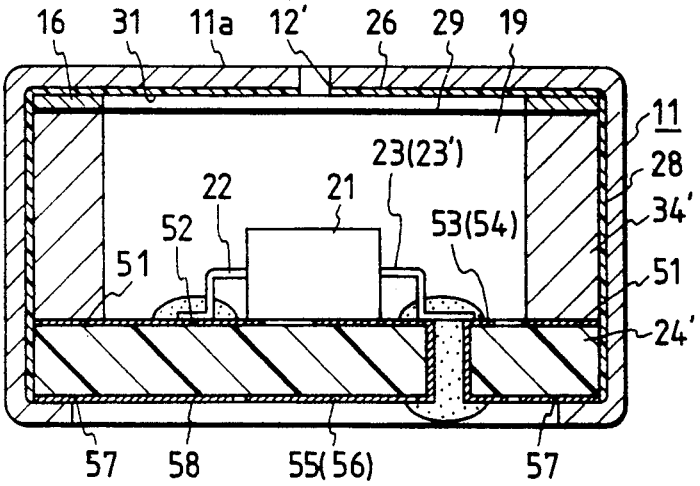
FIG. 12 is a sectional view depicting another modified embodiment of FIG. 10A.

In the embodiment of FIG. 12, a ring-shaped spacer 16 is intercalated between the electret polymer film 26 on the rear side of the front face plate 11*a* and the electrically conductive diaphragm 29, instead of forming a recess in the rear surface of the front face plate 11*a* of the capsule 11. In addition, an electrically conductive cylindrical member 34' is disposed between the electrically conductive diaphragm 29 and the double-side wiring board 24'. The electrically conductive diaphragm 29 is held by either the rear end surface of the spacer 16 or the front end surface of the electrically conductive cylindrical member 34'. By means of the spacer 16, a spacing between the electret polymer film 26 and the electrically conductive diaphragm 29 is regulated into specified dimensions. Other details of the composition are similar to those of FIG. 10A.

Figure 13A:
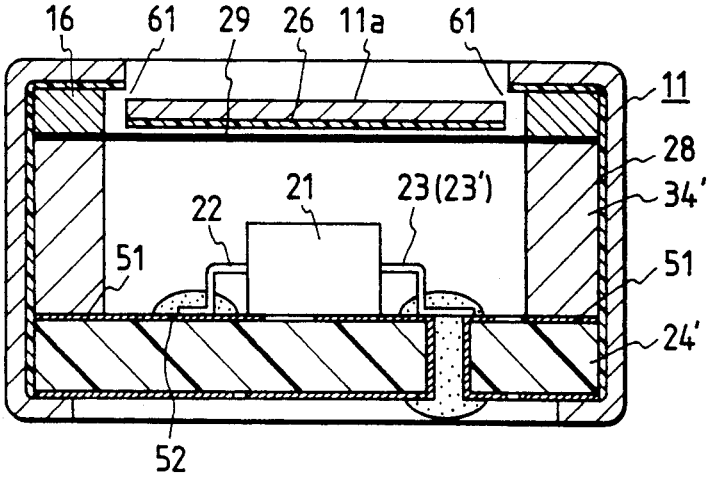
FIG. 13A is a sectional view for indicating still another modified embodiment of FIG. 10A.
Figure 13B:
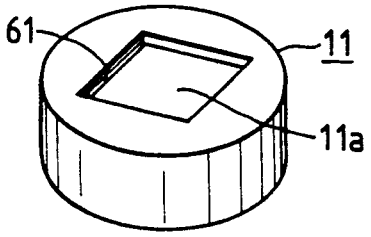
FIG. 13B is an oblique view of the capsule 11 in FIG. 13A.

An embodiment modified from that of FIG. 12 is shown in FIGS. 13A and 13B, in which a square area of the front face plate 11*a* of the capsule 11 is depressed inwardly. That is, it is pressed inwardly to form a step difference slightly greater than the thickness of the plate 11*a* so that two opposite edges of the depression are sheared vertically to form narrow slits 61, while the other two edges form sloped continuous steps. Other details of the composition are similar to those in FIG. 10A. Since the narrow slits 61 are used as sound holes as described above, it is effectively prevented that dust or any foreign object enters the sound holes, thus the diaphragm 29 will be kept clean, so a cloth to be stuck on the front face plate 11*a* can be omitted. Furthermore, in the various embodiments as described so far, each sound hole 12 or 12' is formed in a plane parallel to the front face plate 11*a*. Therefore, when the capsule 11 is viewed from the front side, part of the electrically conductive diaphragm 29 is exposed outside. To the contrary, in the embodiment of FIGS. 13A and 13B, the slits 61 are formed substantially vertical to the front face plate 11*a*. Consequently, the electrically conductive diaphragm 29 is not exposed, which brings about a higher electromagnetically shielding effect. Therefore, the embodiment realizes an advantage of a lower level of the induction noise applied to the electrically conductive diaphragm 29 connected to the high impedance input side of the impedance conversion device 21.

Figure 14A:
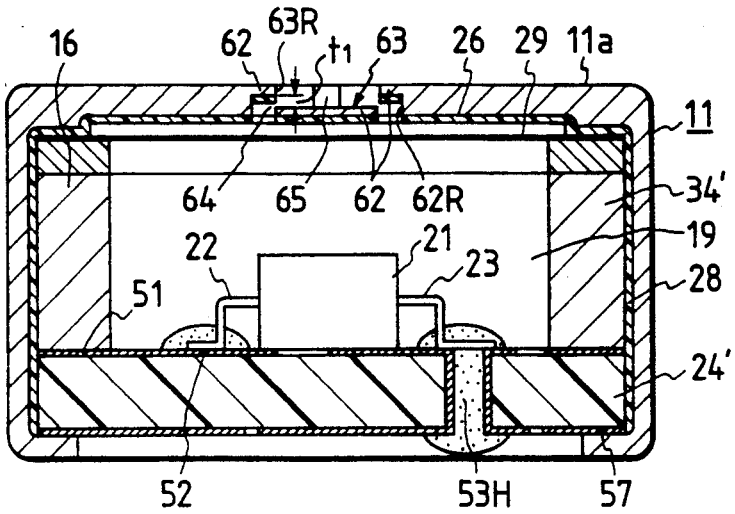
FIG. 14A is a sectional view of another embodiment of the microphone according to the present invention.
Figure 14B:
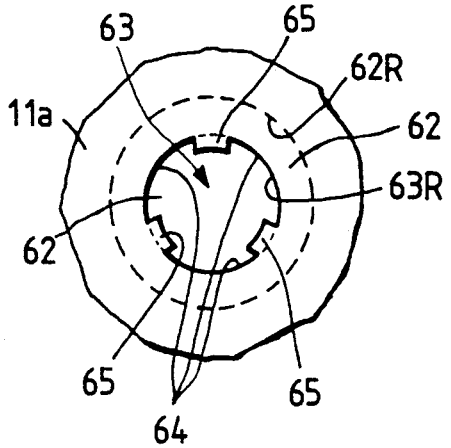
FIG. 14B is a front part view of the front face plate 11*a*, for showing the surroundings of the slits 64 composing the sound hole of FIG. 14A.

The embodiment depicted in FIG. 13A has been explained to have slits 61 which are formed by shearing two opposite sides of a pressed square recess in the front face plate 11*a*. It is also possible to provide a plurality of arc-shaped, sheared slits in equal angular spacings on the circumference of a circular pressed recess. Such an embodiment is shown in FIG. 14A. On the rear side of the front face plate 11*a* of a cylindrical capsule 11 made of a metal such as aluminum, a circular region shown by a broken line 62R in FIG. 14B is recessed making the thickness thereof smaller than one half of the thickness of other parts, thus forming a thin-wall portion 62 beforehand. In a coaxial relationship with the circular thin-wall portion 62, a recess 63 of a circle 63R in a smaller diameter is formed by pressing the front face plate 11*a* from the front side thereof using a press machine. At that time, the thin-wall portion 62 is sheared on the circle 63R in equal angular intervals, while leaving a connection portion 65, thereby forming vertical slits 64.

For instance, the thickness of the front face plate 11*a* is 0.3 mm while the thickness of the thin-wall portion 62 formed by pressing the rear side thereof toward the front side is 0.1 mm. The rear side of the thin wall portion 62 in the recess 63 is on the same plane as the rear side of the front face plate 11*a*. Therefore, the vertical gap "t" of the slits 64 becomes 0.1 mm. The diameter of the circular recess 63 is 3 mm. In such a manner as described above, slits 64 are formed perpendicular to the front face plate 11*a* and in between the outer side of the front face plate 11*a* and the rear side. Other details of the composition are similar to those in FIG. 11.

Figure 15:
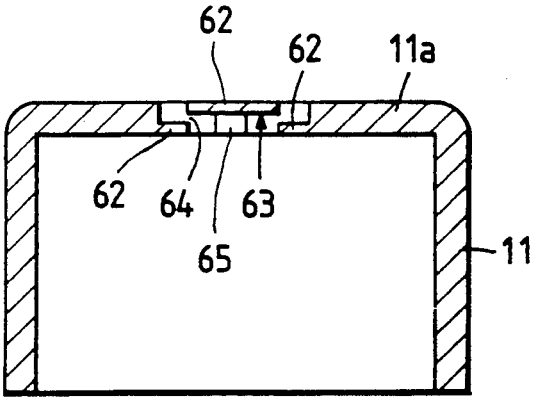
FIG. 15 is a sectional view of a capsule depicting another construction of the slits 64.

The embodiment of FIG. 14A relates to a case where the circular recess 62 is formed in the front side of the front face plate 11*a*. As shown in FIG. 15, the circular recess 63 can also be formed in the rear side of the front face plate 11*a*. In addition, the thin-wall portion 62 and the circular recess 63 may also be shaped rectangular or polygonal instead of circular.

Figure 16:
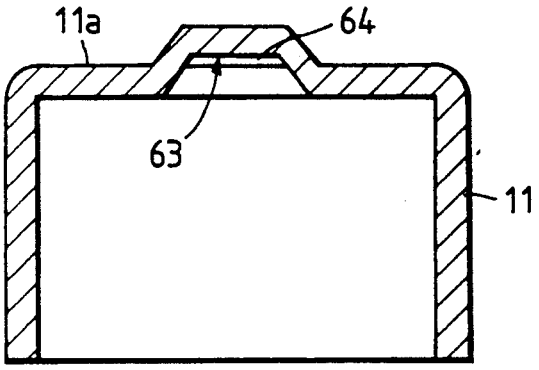
FIG. 16 is a sectional view of a capsule depicting still another construction of the slits 64.
Figure 17:
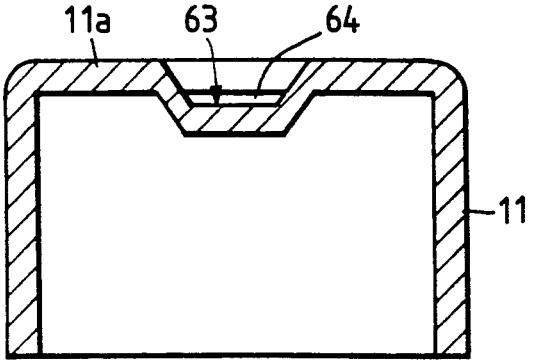
FIG. 17 is a sectional view of a capsule showing another construction of the slits 64.

Another method of forming slits 64 is that, instead of forming the thin-wall portion 62 as shown in FIGS. 14A and 15, an inner portion of the front face plate 11*a* is pressed forward from the outer side while leaving connecting portions thereof in a tapered thin shape and shearing other portions to form vertical slits 64, as shown in FIG. 16. On the other hand, as shown in FIG. 17, a center portion of the front face plate 11*a* may be pushed inward thus forming vertical slits 64. Furthermore, slits may also be formed to extend in radial directions.

According to the present invention as described above, unlike a conventional microphone unit, at least no back electrode is needed and correspondingly, the number of required parts is smaller while facilitating automatic assembling. In the case that the spacer is also omitted in particular, the microphone unit according to the present invention is more suitable for automatic assembling.

Moreover, where a diaphragm of an electret is used in a conventional system, it is difficult to make the thickness less than 12.5 μm, which results in a correspondingly low sensitivity, namely −45 dB at 1 KHz. However, according to the present invention, the thickness of the diaphragm 29 can be made as thin as for instance 2 μm. According to the arrangement of FIG. 3, the sensitivity can be improved to −38 dB at 1 KHz, that is, higher than the conventional limit as much as 7 dB. As a result, S/N also becomes more than 45 dB, namely 5 dB higher than those of conventional units.

Since the electret film 26 is formed on the inner surface of the capsule, the thickness thereof can be made larger, for instance 25 μm. Hence, the variance of polarizing degrees in products is correspondingly smaller and the stability of polarizing degrees is higher.

What is claimed is:

1. An electret condenser microphone unit comprising:

a cylindrical portion and a metal capsule having a front face plate that is disposed to close an end of said cylindrical portion and provided with a sound hole;

an electret polymer film attached on a rear side of said front face plate in said capsule;

an electrically conductive diaphragm disposed in close opposition to said polymer film with a spacing, in said capsule;

an electrically conductive holding means engaging a peripheral portion of said electrically conductive diaphragm in said capsule;

a wiring board closing a rear side of said capsule; and an impedance conversion IC device disposed in said capsule and connected to said electrically conductive holding means, said wiring board and said capsule.

2. The microphone unit of claim 1, in which a rear end of said electrically conductive holding means is disposed in opposition to and in contact with said wiring board and composes a rear chamber conductive holding means in rearward of said electrically conductive diaphragm.

3. The microphone unit of claim 1, in which a cylindrical element of insulation material is disposed between said electrically conductive holding means and said wiring board, and a rear chamber is composed rearward of said electrically conductive diaphragm by said cylindrical element.

4. The microphone unit of claim 1, in which said cylindrical portion and said front face plate are formed integrally with each other, and a polymer film continued from said electret polymer film is attached to and covers the inner peripheral surface of said cylindrical portion.

5. The microphone unit of claim 4, in which a rear end of said cylindrical portion is bent toward and calked at the fringe of a rear side of said wiring board.

6. The microphone unit of claim 5, in which a metal surface is exposed on the inner peripheral surface at the rear end of said cylindrical portion and is in contact with a conductor pattern formed on the rear side of said wiring board.

7. The microphone unit of claim 4, in which a recess portion is formed on the rear side of said front face plate except for a fringe portion of said diaphragm, and said electrically conductive holding means presses said fringe portion of said electrically conductive diaphragm against the peripheral portion on the rear side of said front face plate.

8. The microphone unit of claim 1 or 4, in which a cylindrical element of insulation material is intercalated between said electrically conductive holding means and said wiring board to form a rear chamber behind said electrically conductive diaphragm, and an input terminal of said impedance conversion IC device is connected to said electrically conductive holding means.

9. The microphone unit of claim 8, in which said input terminal of said IC device is intercalated between said electrically conductive holding means and said cylindrical element.

10. The microphone unit of claim 1 or 4, in which a rear end of said electrically conductive holding means is extended in opposition to and in contact with said wiring board to form a rear chamber behind said electrically conductive diaphragm.

11. The microphone unit of claim 1 or 4, in which a ring-shaped spacer is provided between a peripheral portion of the rear side of said front face plate and the peripheral portion of said electrically conductive diaphragm, and defines said spacing therebetween.

12. The microphone unit of claim 1, in which said front face plate is formed separately from said cylindrical portion and is pressed into and fit in an aperture formed at a front end of said cylindrical portion.

13. The microphone unit of claim 1, in which said cylindrical portion is provided with a flange portion having a front end that is bent inwardly in the radial direction, and said front face plate is formed separately from said cylindrical portion and disposed in opposition to and in contact with a rear side of said flange portion.

14. The microphone unit of claim 4, in which said wiring board is a double-sided wiring board on an upper side of which there are a peripheral conductor pattern in opposition to and in contact with the rear end surface of said electrically conductive holding means and an input terminal conductor pattern extended from said peripheral conductor pattern and connected to the input terminal of said IC device.

15. The microphone unit of claim 14, in which an upper surface of said wiring board is provided with an upper surface output terminal conductor pattern connected to the output terminal of said IC device, and a rear surface of said wiring board is provided with a common conductor pattern in contact with a rear end portion of said cylindrical portion and a rear surface output conductor pattern at least a part of which overlaps with said upper surface output terminal conductor pattern, and said upper and rear surface output conductor patterns are electrically connected together through a hole formed in said wiring board.

16. The microphone unit of claim 14, in which said electrically conductive holding means comprises an electrically conductive ring in opposition to and in contact with the peripheral portion of said electrically conductive diaphragm and an electrically conductive cylinder intercalated between said electrically conductive ring and said wiring board.

17. The microphone unit of claim 1, 4 or 14, in which said sound hole comprises a partially cut vertical slit formed at an edge of a protrusion portion formed by pressing said front face plate, in a direction substantially perpendicular to the plane of said front face plate.

18. The microphone unit of claim 17, in which said protrusion portion is in a thin wall zone of said face plate where the wall thickness is made smaller by forming a recess on one side of said front face plate, from the other side to said one side of said front face plate.

19. The microphone unit of claim 17, wherein said protrusion portion protrudes from one side to the other side of said front face plate.

* * * * *